US008248194B2

(12) United States Patent
Fisher et al.

(10) Patent No.: US 8,248,194 B2
(45) Date of Patent: Aug. 21, 2012

(54) DISCONNECT SWITCH

(75) Inventors: Dan A. Fisher, Dublin, OH (US); Michael J. Holland, Hilliard, OH (US)

(73) Assignee: Siemens Industry, Inc., Alpharetta, GA (US)

( * ) Notice: Subject to any disclaimer, the term of this patent is extended or adjusted under 35 U.S.C. 154(b) by 219 days.

(21) Appl. No.: 12/787,983

(22) Filed: May 26, 2010

(65) Prior Publication Data

US 2011/0193664 A1 Aug. 11, 2011

Related U.S. Application Data

(60) Provisional application No. 61/303,123, filed on Feb. 10, 2010, provisional application No. 61/314,805, filed on Mar. 17, 2010.

(51) Int. Cl.
*H01H 9/00* (2006.01)

(52) U.S. Cl. ..... 335/179; 335/201
(58) Field of Classification Search ..... 335/179, 335/201
See application file for complete search history.

(56) References Cited

U.S. PATENT DOCUMENTS 4,367,448 A * 1/1983 Nishizako ..... 335/201
* cited by examiner

*Primary Examiner* — Ramon Barrera

(57) ABSTRACT

A disconnect switch includes a case having a movable contact, a stationary contact and a plurality of magnets. The movable contact is adapted to move from a first closed position where it is in physical contact with the stationary contact to a second open position. The magnets are located at predefined locations and in predefined orientations about the axis of movement of the movable contact, whereby upon the movement of the movable contact from the first position to the second open position, a current arc created by the movable contact is extinguished.

14 Claims, 5 Drawing Sheets

DISCONNECT SWITCH

CROSS REFERENCE TO RELATED APPLICATIONS

This application claims the benefit of U.S. Provisional Patent Application Nos. 61/303,123, filed on Feb. 10, 2010 and 61/314,805, filed on Mar. 17, 2010, both of which are incorporated by reference herein as if fully set forth.

FIELD OF INVENTION

This application is related to disconnect switches.

BACKGROUND

A disconnect switch is utilized to disconnect power sources from an electrical system. In a direct current (DC) system, for example, a photovoltaic disconnect switch may be used to disconnect multiple DC power sources from the electric system that is supplied by photovoltaic cells in one or more photovoltaic modules. The Underwriters Laboratory (UL) standard requirement for certification of a photovoltaic disconnect switch are for the device to operate at an overload of 200 percent of the rated current of the switch and to pass an endurance test at the rated current.

However, opening the contacts of a disconnect switch under a DC load creates an arc between the stationary contact, (e.g., line side), and movable contact, (e.g., load side), of the switch. Current industry devices attempt to suppress this arc by connecting two poles of a three pole disconnect switch in series and by using arc grids (e.g., deion plates) to suppress the arc. This series connection creates additional break points in the circuit when the switch is opened, which add to the overall resistance of the circuit, thereby causing the arc to be rapidly extinguished. Additionally, arc grids in some cases break the arc into smaller arcs and cool the arc, which raises the arc voltage and aids in extinguishing the arc.

However, the current devices allow only one line/load combination to be wired through a three pole disconnect switch. When wiring the current devices in a three (3) line/load configuration with no additional series connection, they are not able to meet the necessary number of operations under overload and endurance conditions as required by the UL rating body.

Additionally, arc grids alone work well only when they remain relatively cool. The arc in general rises with natural convection into the arc grids. When the temperature of the arc grids increase during endurance, the heat of the grids begin to repel the arc. This repulsion acts to constrain and shorten the path of the arc. The increase in arc voltage is not achieved and the arc remains active after the disconnect switch is completely open. This failure to rapidly extinguish the arc results in additional heat being built up in the system and the eventual melting of the disconnect switch, since the arc itself may be at a temperature of 20,000 Degrees Kelvin.

It would therefore be beneficial to provide a disconnect switch that does not use arc grids to extinguish the arc.

SUMMARY

A disconnect switch is disclosed. The disconnect switch includes a case having a movable contact, a stationary contact and a plurality of magnets. The movable contact is adapted to move from a first closed position where it is in physical contact with the stationary contact to a second open position. The magnets are located at predefined locations and in predefined orientations about the axis of movement of the movable contact, whereby upon the movement of the movable contact from the first position to the second open position, a current arc created by the movable contact is extinguished.

DETAILED DESCRIPTION OF THE EMBODIMENTS

By utilizing a combination of magnets to extinguish an arc, instead of utilizing an arc grid, space is opened up for the arc to lengthen and cool.

Figure 1:
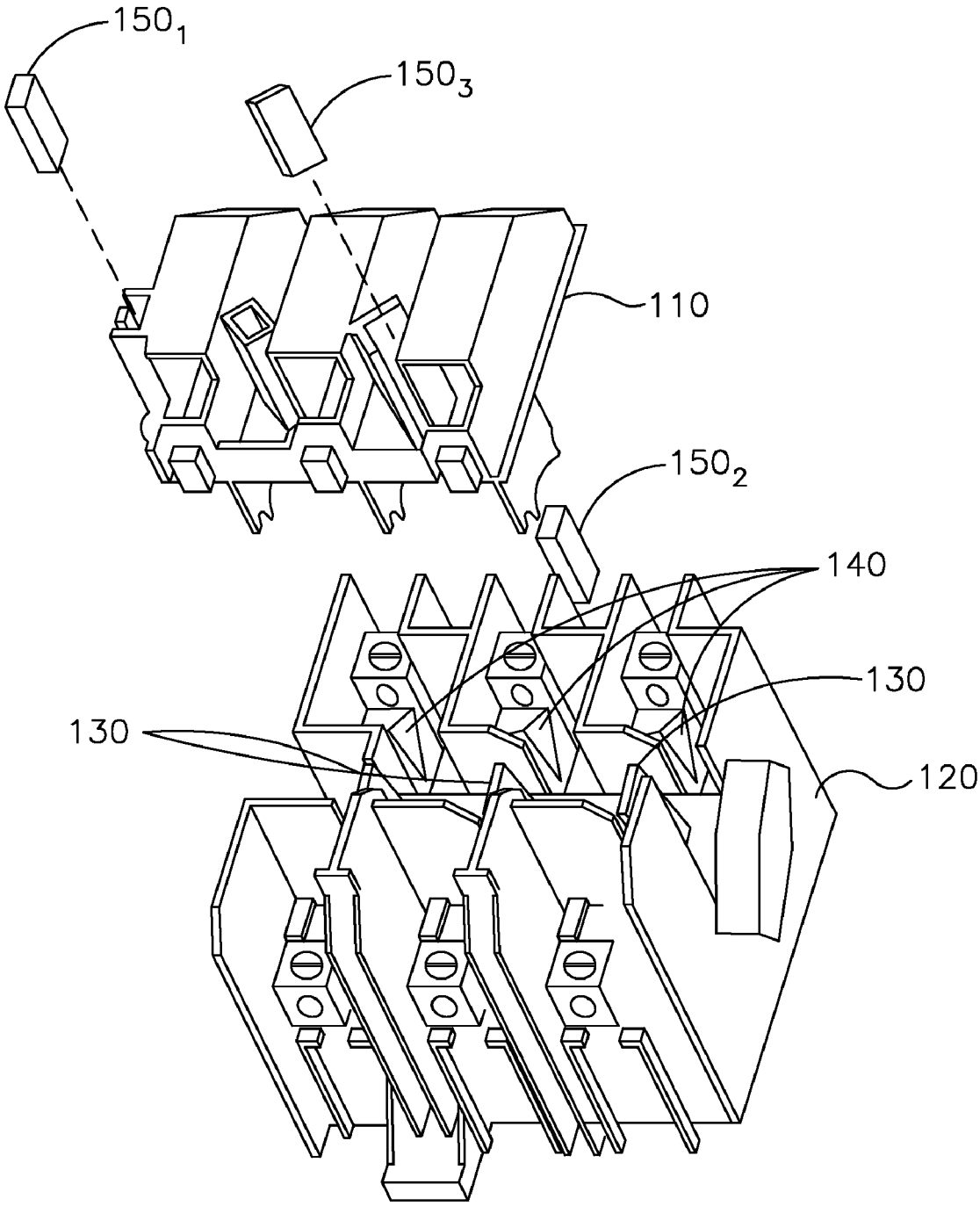
FIG. 1 is an exploded perspective view of a disconnect switch in accordance with an embodiment.

Referring now to the drawings, wherein like reference numerals refer to similar components across the several views, FIG. 1 is an exploded perspective view of a disconnect switch 100 in accordance with an embodiment. The disconnect switch 100 includes a cover 110 and a base 120. Disposed within the base 120 are movable contacts 130 and stationary contacts 140. For purposes of example, a three pole switch 100 is shown, which may have a current rating of 30 amps. Accordingly, three movable contacts 130 are depicted as well as 3 sets of stationary contacts 140. However, it should be noted that an additional number of contacts 130 and 140, or less contacts, may be utilized depending on the desired application. Additionally, it should be noted that although the disconnect switch 100 is depicted as a "double-break" switch, where the movable contact 130 makes/breaks contact at two physical locations with two respective stationary contacts 140, the disconnect switch could also be a "single-break" switch where there is only one physical connection between the movable contact 130 and one respective stationary contact 140.

Disposed within the cover 110 are magnets 150, (designated $\mathbf{150}_1$, $\mathbf{150}_2$, and $\mathbf{150}_3$). Additionally, the cover 110 includes vents to release heat. Again, for purposes of example, three magnets 150 are shown, however, it should be noted that a greater or lower number of magnets may be included, depending on the desired application.

Figure 2:
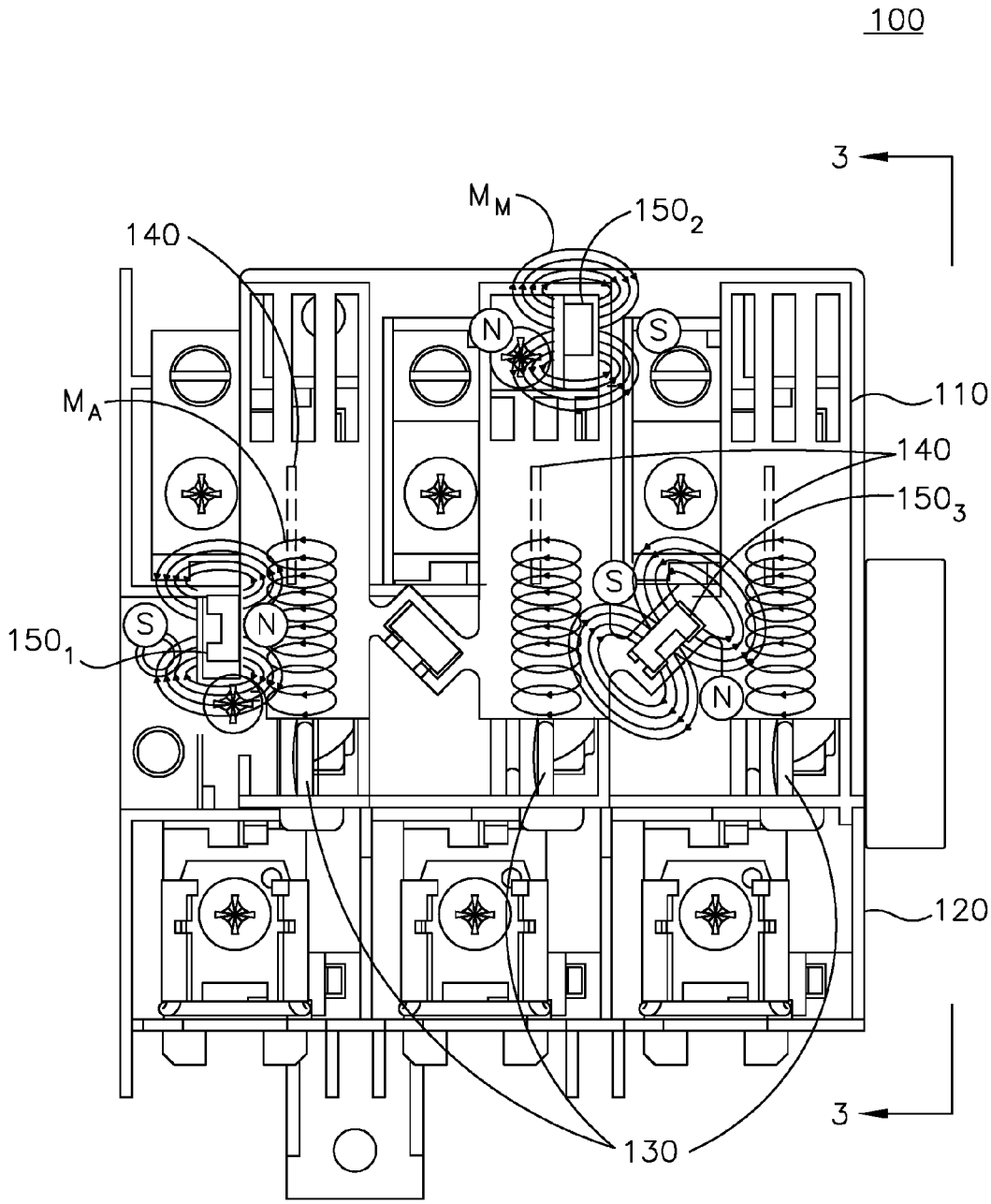
FIG. 2 is a plan view of the disconnect switch of FIG. 1.
Figure 3:
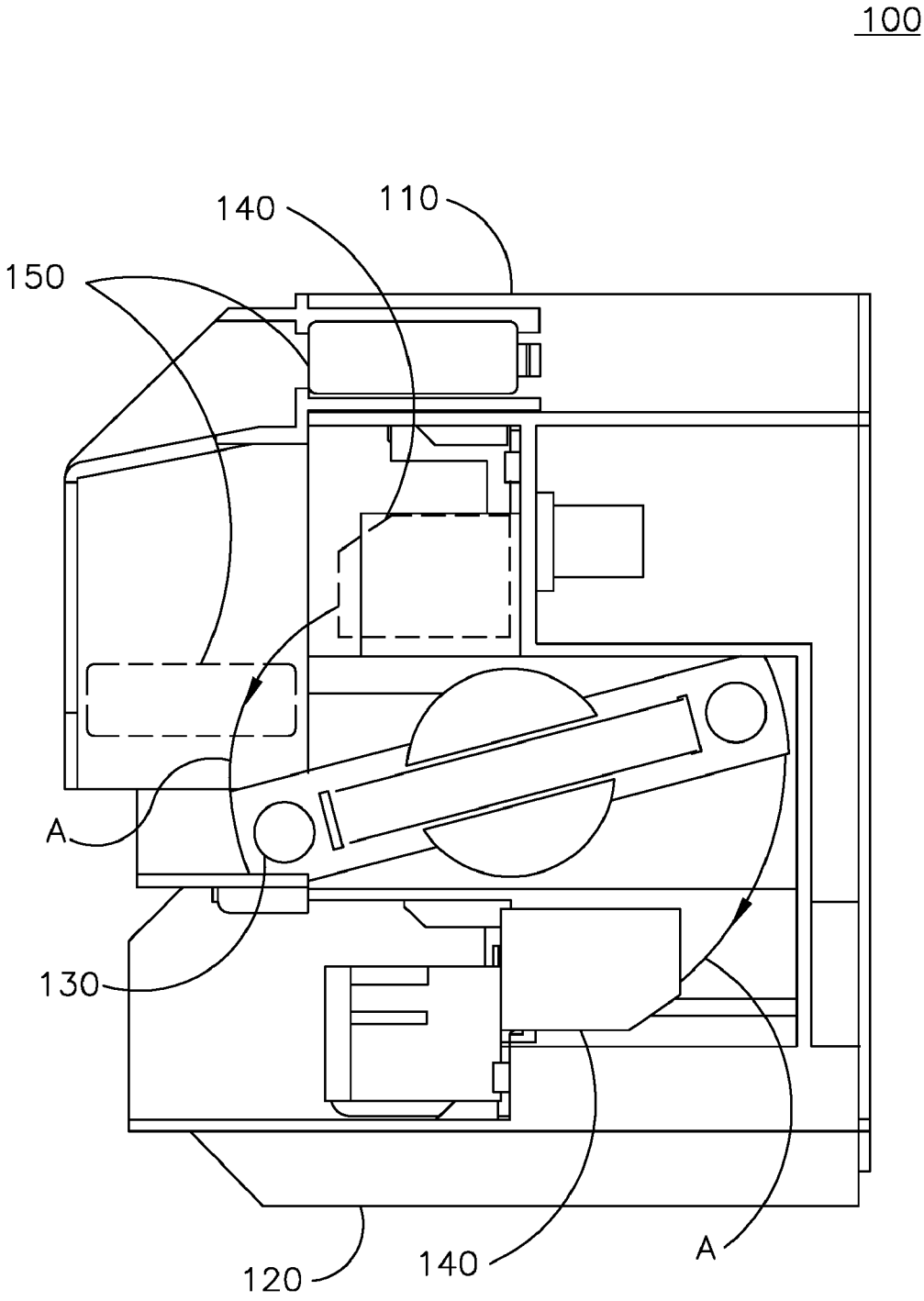
FIG. 3 is a side elevation of the disconnect switch of FIG. 2 viewed along the lines 3-3.

FIG. 2 is a plan view of the disconnect switch 100 of FIG. 1, and FIG. 3 is a side elevation of the disconnect switch 100 of FIG. 2 viewed along the lines 3-3.

Referring now collectively to FIGS. 2 and 3, the operation of the disconnect switch 100 is shown during the opening of the switch. The magnets 150 are shown in a particular orientation with respect to the path and axes of the movable contacts 130. For example, as shown, magnet $\mathbf{150}_1$ is disposed substantially parallel to the axis of the paths of the movable contacts 130, having its north pole facing to the center of the disconnect switch 100 and the south pole facing to the outer wall of the disconnect switch 100 in the view of FIG. 2. Magnet $\mathbf{150}_2$ is disposed substantially parallel to the axis of the paths of the movable contacts 130, having its north pole facing to the left and the south pole facing to the right in the view of FIG. 2. Magnet $\mathbf{150}_3$ is disposed at an angled orientation, (e.g., 45 degrees), with respect to the axes and paths of the movable contacts 130, and having the south pole facing substantially the center of the disconnect switch 100 and the north pole facing toward the outside of the disconnect switch 100. Each of the magnets 150 produces a magnetic field $M_m$ proceeding from the north pole of the magnet to the south pole of the magnet.

As each movable contact 130 rotates about its axis from a first position where it is in physical contact with its respective stationary contact 140 to a second, open, position, an arc "A" is formed along the path of the movable contact 130 in breaking its physical contact with its respective stationary contact 140. A magnetic field $M_A$ is generated by the current flow of each arc. As the arc A proceeds along its path, it is first attracted by the magnetic fields $M_m$ produced by magnets 150, stretching and lengthening the path of the arc by acting on the Arc's magnetic field. That is, the magnetic fields $M_m$ of magnets $\mathbf{150}_1$, $\mathbf{150}_2$ and $\mathbf{150}_3$ first attract the arc A, stretching and lengthening the path of the arc by acting on the Arc's magnetic field. As the movable contact 130 moves past the magnets $\mathbf{150}_1$ and $\mathbf{150}_3$, the arc A is repelled. The combination of attracting and repelling the arc A increases its voltage above the system voltage, (e.g., 600V and higher), which aids in extinguishing the arc. In addition, the magnetic fields of the magnets deflect the arc plasma, which causes an additional increase in the arc voltage. This effect may be referred to as the "Hall" effect. Since ions may be many times heavier than electrons, (e.g., 10,000 times heavier), as the electrons are pushed out of the plasma stream, the stream ceases to be a good conductor and extinguishes. The arc is also cooled through the vents of the cover 110 through convection.

Figure 4:
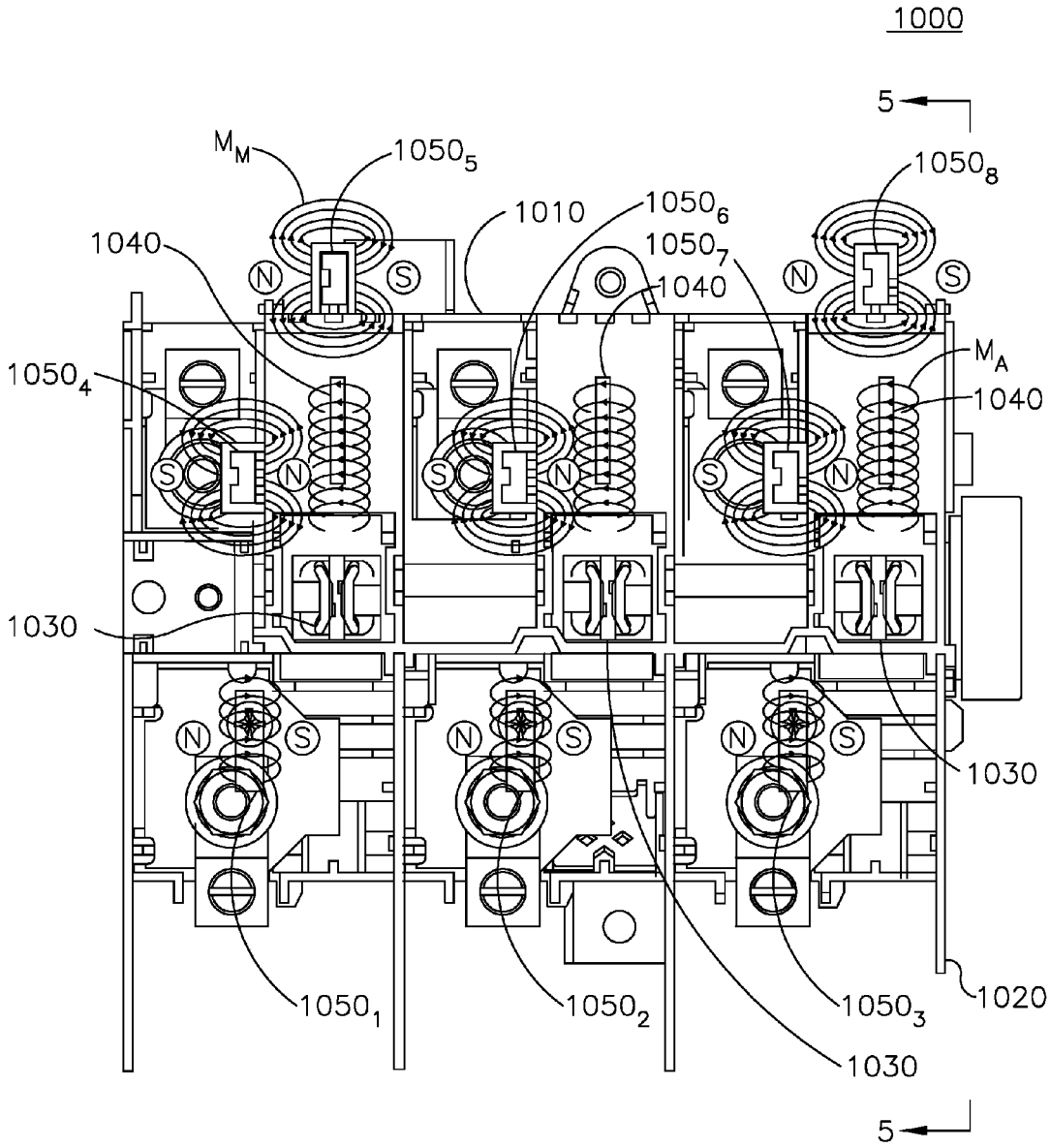
FIG. 4 is a plan view of a disconnect switch in accordance with an alternative embodiment.
Figure 5:
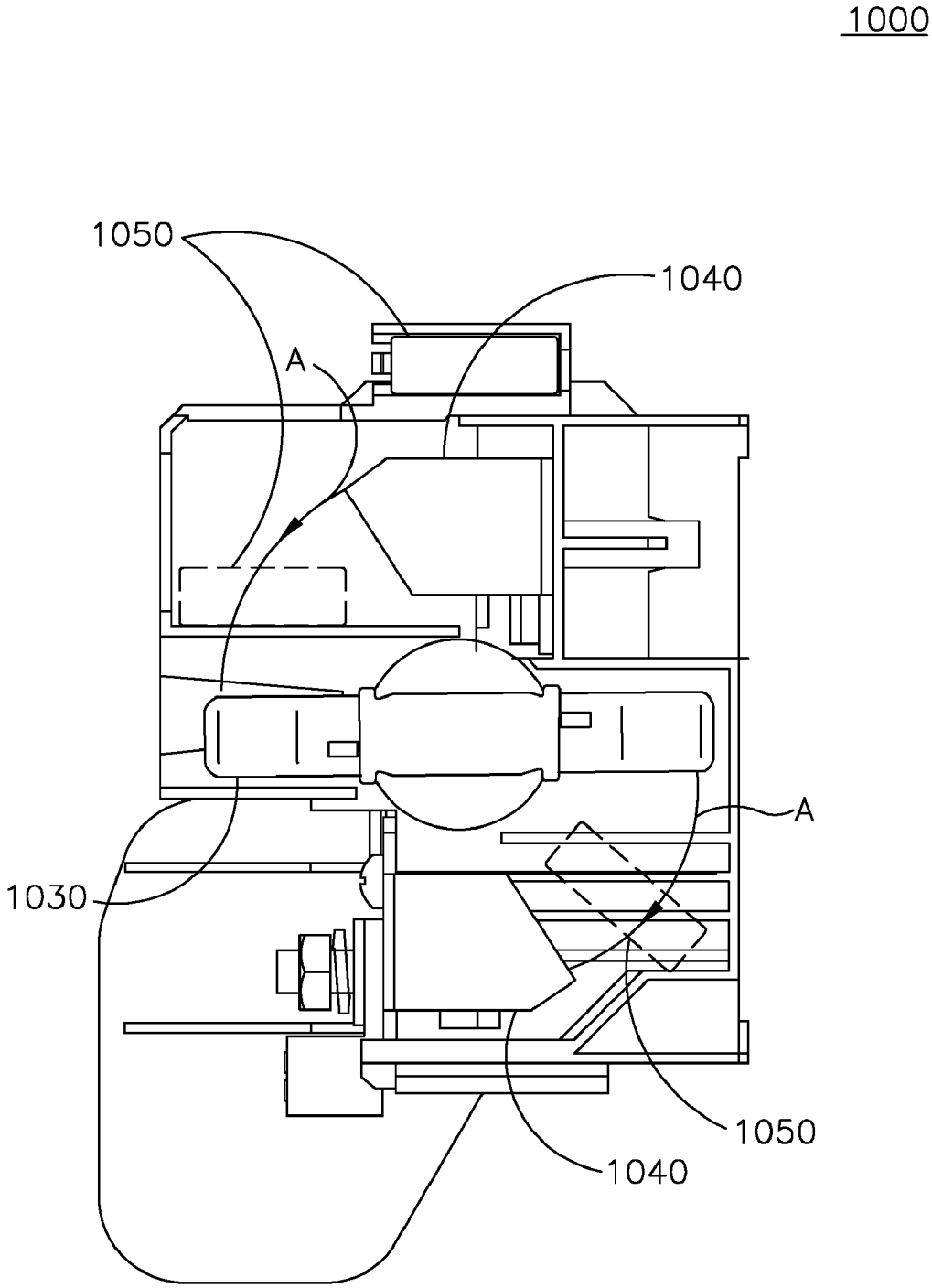
FIG. 5 is a side elevation of the disconnect switch of FIG. 4 viewed along the lines 5-5.

FIG. 4 is a plan view of a disconnect switch 1000 in accordance with an alternative embodiment, and FIG. 5 is a side elevation of the disconnect switch 1000 of FIG. 4 viewed along the lines 5-5. The disconnect switch 1000 includes a cover 1010 and a base 1020. Disposed within the base 1020 are movable contacts 1030 and stationary contacts 1040. For purposes of example, a three pole switch 1000 is shown, which may have a current rating of 60 or 100 amps. Accordingly, three movable contacts 1030 are depicted as well as 3 sets of stationary contacts 1040. However, it should be noted that an additional number of contacts 1030 and 1040, or less contacts, may be utilized depending on the desired application. Additionally, it should be noted that although the disconnect switch 1000 is depicted as a "double-break" switch, where the movable contact 1030 makes/breaks contact at two physical locations with two respective stationary contacts 1040, the disconnect switch could also be a "single-break" switch where there is only one physical connection between the movable contact 1030 and one respective stationary contact 1040.

In this embodiment, disposed within the base 1020 are three magnets ($\mathbf{1050}_1$, $\mathbf{1050}_2$, and $\mathbf{1050}_3$), while disposed within the cover 1010 are five magnets ($\mathbf{1050}_4$, $\mathbf{1050}_5$, $\mathbf{1050}_6$, $\mathbf{1050}_7$, and $\mathbf{1050}_8$). Additionally, the cover 1010 includes vents to release heat. Again, for purposes of example, eight magnets 1050 are shown, however, it should be noted that a greater or lower number of magnets may be included, depending on the desired application.

Referring now collectively to FIGS. 4 and 5, the operation of the disconnect switch 1000 is shown during the opening of the switch. The magnets 1050 are shown in a particular orientation with respect to the path and axes of the movable contacts 1030. For example, as shown, magnets $\mathbf{1050}_1$, $\mathbf{1050}_2$, and $\mathbf{1050}_3$ are disposed substantially parallel to the axis of the paths of the movable contacts 1030, having their north pole facing to the left of the disconnect switch 1000 and their south poles facing to the right of the disconnect switch 1000 in the view of FIG. 4. In addition, the magnets $\mathbf{1050}_1$, $\mathbf{1050}_2$, and $\mathbf{1050}_3$ are oriented at an angle, (e.g., 45 degrees), with respect to the bottom plane of the base 1020.

Disposed within the cover 1010 are magnets $\mathbf{1050}_4$, $\mathbf{1050}_5$, $\mathbf{1050}_6$, $\mathbf{1050}_7$, and $\mathbf{1050}_8$ substantially parallel to the axis of the paths of the movable contacts 1030. Magnets $\mathbf{1050}_5$ and $\mathbf{1050}_8$ each have their north poles facing to the left and the south poles facing to the right in the view of FIG. 4. Magnets $\mathbf{1050}_4$, $\mathbf{1050}_6$, and $\mathbf{1050}_7$ each have their north poles facing to the right and the south poles facing to the left in the view of FIG. 4, (i.e., the opposite to the pole orientations of magnets $\mathbf{1050}_5$ and $\mathbf{1050}_8$). Each of the magnets 1050 produces a magnetic field $M_m$ proceeding from the north pole of the magnet to the south pole of the magnet.

As each movable contact 1030 rotates about its axis from a first position where it is in physical contact with its respective stationary contact 1040 to a second, open, position, an arc "A" is formed along the path of the movable contact 1030 in breaking its physical contact with its respective stationary contact 1040. A magnetic field $M_A$ is generated by the current flow of each arc. As the arc A proceeds along its path, it is attracted immediately upon creation by the magnetic fields $M_m$ produced by magnets $\mathbf{1050}_5$ and $\mathbf{1050}_8$, stretching and lengthening the path of the arc by acting on the Arc's magnetic field, due to the magnets' locations proximate to the stationary contacts 1040.

Also, as the arc A proceeds along its path, it is first attracted by the magnetic fields $M_m$ produced by magnets $\mathbf{1050}_1$, $\mathbf{1050}_2$, $\mathbf{1050}_3$, $\mathbf{1050}_4$, $\mathbf{1050}_6$, and $\mathbf{1050}_7$, stretching and lengthening the path of the arc by acting on the Arc's magnetic field, and then repelled by their magnetic fields as the movable contact 1030 moves past the magnets $\mathbf{1050}_1$, $\mathbf{1050}_2$, $\mathbf{1050}_3$, $\mathbf{1050}_4$, $\mathbf{1050}_6$, and $\mathbf{1050}_7$. The combination of attracting and repelling the arc A increases its voltage above the system voltage, (e.g., 600V and higher), which aids in extinguishing the arc. In addition, the magnetic fields of the magnets deflect the arc plasma, which causes an additional increase in the arc voltage. This effect may be referred to as the "Hall" effect. Again, since the ions may be many times heavier than the electrons, as the electrons are pushed out of the plasma stream, the stream ceases to be a good conductor and extinguishes. The arc is also cooled through the vents of the cover 1010 through convection. In addition, the magnets $\mathbf{1050}_1$, $\mathbf{1050}_2$, $\mathbf{1050}_3$, $\mathbf{1050}_4$, $\mathbf{1050}_6$, and $\mathbf{1050}_7$ twist the arc to further aid in the extinguishing of the arc.

The above embodiments provide a disconnect switch, for example a photovoltaic disconnect switch, that rapidly stretch, attract, repel, and twist an arc generated during the breaking of contact between a movable contact in the switch with a stationary contact in order to extinguish the arc. The arc is thereby extinguished before the contacts are fully open allowing the disconnect switch to operate at higher voltages, such as 600V and higher, and break current higher than rated current, (e.g., twice rated current), at that voltage. Additionally, the above embodiments provide for the breaking of multiple independent sources in a single disconnect switch. Although the disconnect switches 100 and 1000 are described as including a separate cover and base portion, it should be noted that the switches 100 and 1000 may be formed as a single case unit. In addition, example magnets 150 may be formed of a material such as a grade 35 Neodymium-Iron-Boron (NdFeB), having a coating in accordance with the American Society for Testing and Materials (ASTM) standard B689-97, although other types of magnets may be used.

The foregoing embodiments have been shown and described for the purposes of illustrating the structural and functional principles of the embodiments, as well as illustrating the methods of employing the embodiments and are subject to change without departing from such principles. All modifications to the embodiments are therefore encompassed within the spirit of the following claims.

What is claimed is:

1. A disconnect switch, comprising:

a case;

a movable contact disposed within the case, the movable contact adapted to rotate from a first closed position to a second open position;

a stationary contact disposed within the case, the movable contact being in physical contact with the stationary contact in the first position; and a plurality of magnets, including a first, second and third magnet, disposed within the case, the magnets disposed at predefined locations and orientations about an axis of a path of rotation of the movable contact, whereby upon the rotation of the movable contact from the first position to the second open position, a current arc created by the movable contact is extinguished, wherein the first magnet is disposed on a first side of the moveable contact, substantially parallel to the axis of the path of rotation of the moveable contact, the north pole of the first magnet facing the first movable contact, wherein the second magnet is disposed proximate an end of the stationary contact, and substantially parallel to the axis of the path of rotation of the moveable contact, the second magnet oriented opposite in polarity to the first magnet, and wherein the third magnet is disposed on a second side of the moveable contact opposite the first side, at a forty-five degree angle with respect to the axis of the path of rotation the movable contact, the south pole of the third magnet facing a direction substantially towards the north pole of the first magnet, and the north pole of the third magnet facing a direction substantially away from the north pole of the first magnet.

2. The disconnect switch of claim 1 wherein the case further comprises:

a cover; and a base;

wherein the movable and stationary contacts are disposed within the base and the plurality of magnets are disposed within the cover.

3. The disconnect switch of claim 2 wherein the cover further comprises at least one vent opening.

4. The disconnect switch of claim 1 wherein the arc is attracted to at least one of the magnets, and repelled by at least one of the magnets to lengthen the arc.

5. The disconnect switch of claim 1 wherein the plurality of magnets deflect the arc plasma.

6. A disconnect switch comprising:

a case;

a movable contact disposed within the case, the movable contact adapted to move from a first closed position to a second open position;

a stationary contact disposed within the case, the movable contact being in physical contact with the stationary contact in the first position; and a plurality of magnets disposed within the case, the magnets disposed at predefined locations and orientations about an axis of movement of the movable contact whereby upon the movement of the movable contact from the first position to the second open position, a current arc created by the movable contact is extinguished, and wherein the plurality of magnets include a first, second, third, fourth, fifth, sixth, seventh, and eighth magnet disposed within the case substantially parallel to an axis of a path of the movable contact when transitioning from the first position to the second position, wherein the polarities of the first, second, third, fifth and eighth magnets are in a first direction and the polarities of the fourth, sixth and seventh magnets are in a second direction that is opposite to the first direction, the first, second and third magnets further being oriented at a predefined angle with respect to a bottom plane of the case.

7. The disconnect switch of claim 6 wherein the predefined angle with respect to the bottom of the case is forty-five degrees.

8. The disconnect switch of claim 6 wherein upon the movable contact breaking physical contact from the stationary contact in the first position, an arc generated by the movable contact is attracted by the first, second, third, fourth, fifth, sixth, seventh, and eighth magnets, then repelled by the first, second, third, fourth, sixth and seventh magnets to lengthen the arc.

9. The disconnect switch of claim 8 wherein the first, second, third, fourth, sixth and seventh magnets deflect the arc plasma.

10. The disconnect switch of claim 9 wherein the first, second, third, fourth, sixth and seventh magnets attract, repel and twist the arc to increase the voltage of the arc.

11. A disconnect switch, comprising:

a case including a cover having a plurality of vents, and a base, the cover being removably mounted to the base;

a first, second, and third movable contact disposed in the base, adaptable for movement from a first, closed, position, to a second, open, position;

a first, second and third stationary contact disposed in the base, each stationary contact associated with a respective movable contact whereby the respective movable contact is physically connected to the stationary contact when the movable contact is in the first position;

a first magnet disposed within the cover of the base proximate the first movable contact on a side of the movable contact opposite the side facing the second movable contact, the first magnet oriented substantially parallel to an axis of travel of the first, second and third movable contacts when transitioning from their respective first positions to their respective second positions, the north pole of the first magnet facing the first movable contact;

a second magnet disposed within the cover of the base proximate to and parallel to the axis of travel of the second movable contact, the second magnet situated between a path of travel of the second and third movable contacts and distant from the first magnet, the north pole of the second magnet oriented opposite in polarity to the first magnet; and a third magnet disposed within the cover of the base between the second and third movable contacts, the third magnet oriented at a forty-five degree angle with respect to the axis of travel of the first, second and third movable contacts, the south pole of the third magnet facing substantially the second movable contact and the north pole of the third magnet facing substantially the third movable contact; and wherein upon an arc generated by each of the first, second and third movable contacts upon transitioning from their respective first positions to their respective second positions, the arc is extinguished by the magnetic field of the second magnet attracting the arc to lengthen the arc and increase its voltage and the magnetic fields of the first and third magnets attracting and repulsing the arc to lengthen the arc and increase its voltage.

12. A disconnect switch, comprising:

a case including a cover having a plurality of vents, and a base, the cover being removably mounted to the base;

a first, second, and third movable contact disposed in the base, adaptable for movement from a first, closed, position, to a second, open, position;

a first, second and third stationary contact disposed in the base, each stationary contact associated with a respective movable contact whereby the respective movable contact is physically connected to the stationary contact when the movable contact is in the first position;

a first magnet disposed within the base oriented substantially parallel to the axis of travel of the first, second and third movable contacts when transitioning from their respective first positions to their respective second positions, the first magnet further oriented at a forty-five degree angle with respect to a bottom plane of the base and the south pole of the first magnet substantially facing the axis of travel of the first movable contact;

a second magnet disposed within the base oriented substantially parallel to the axis of travel of the first, second and third movable contacts when transitioning from their respective first positions to their respective second positions, the second magnet further oriented at a forty-five degree angle with respect to the bottom plane of the base and the south pole of the second magnet substantially facing the axis of travel of the second movable contact;

a third magnet disposed within the base oriented substantially parallel to the axis of travel of the first, second and third movable contacts when transitioning from their respective first positions to their respective second positions, the third magnet further oriented at a forty-five degree angle with respect to the bottom plane of the base and the south pole of the third magnet substantially facing the axis of travel of the third movable contact;

a fourth magnet disposed within the cover of the base proximate the first movable contact on a side of the movable contact opposite the side facing the second movable contact, the fourth magnet oriented substantially parallel to an axis of travel of the first, second and third movable contacts when transitioning from their respective first positions to their respective second positions and substantially along a same line as the first magnet, the north pole of the fourth magnet facing the first movable contact;

a fifth magnet disposed within the cover of the base substantially along the axis of travel of the first movable contact and located distant to the first, second and third magnets, the south pole of the fifth magnet oriented in the direction of the axis of the travel of the second movable contact;

a sixth magnet disposed within the cover of the base between the first and second movable contacts, the sixth magnet oriented substantially parallel to an axis of travel of the first, second and third movable contacts when transitioning from their respective first positions to their respective second positions and substantially along a same line as the second magnet, the north pole of the sixth magnet facing the second movable contact;

a seventh magnet disposed within the cover of base between the second and third movable contacts, the seventh magnet oriented substantially parallel to an axis of travel of the first, second and third movable contacts when transitioning from their respective first positions to their respective second positions and substantially along a same line as the third magnet, the north pole of the seventh magnet facing the third movable contact; and an eighth magnet disposed within the cover of the base substantially along the axis of travel of the third movable contact and located distant to the first, second and third magnets, the north pole of the eighth magnet oriented in the direction of the axis of the travel of the second movable contact; and wherein upon an arc generated by each of the first, second and third movable contacts upon transitioning from their respective first positions to their respective second positions, the arc is extinguished by the magnetic fields of the fifth and eighth magnets attracting the arc to lengthen the arc and increase its voltage, and by the magnetic fields of the first, second, third, fourth, sixth, and seventh magnets attracting, repulsing, and twisting the arc to lengthen the arc and increase its voltage.

13. A disconnect switch, comprising:

a case;

a first, second, and third movable contact disposed in the base, adaptable for rotational movement from a first, closed, position, to a second, open, position;

a first, second and third stationary contact disposed in the base, each stationary contact associated with a respective movable contact whereby the respective movable contact is physically connected to the stationary contact when the movable contact is in the first position;

a first magnet disposed within the cover of the base proximate the first movable contact on a side of the movable contact opposite the side facing the second movable contact, the first magnet oriented substantially parallel to an axis of travel of the first, second and third movable contacts when transitioning from their respective first positions to their respective second positions;

a second magnet disposed within the cover of the base proximate to and parallel to the axis of travel of the second movable contact, the second magnet situated proximate an end of the second stationary contact; and a third magnet disposed within the cover of the base between the second and third movable contacts, the third magnet oriented at a forty-five degree angle with respect to the axis of travel of the first, second and third movable contacts;

wherein upon an arc generated by each of the first, second and third movable contacts upon transitioning from their respective first positions to their respective second positions, the arc is extinguished by the magnetic field of the second magnet attracting the arc to lengthen the arc and increase its voltage and the magnetic fields of the first and third magnets attracting and repulsing the arc to lengthen the arc and increase its voltage.

14. A disconnect switch, comprising:

a case including a cover having a plurality of vents, and a base, the cover being removably mounted to the base;

a first, second, and third movable contact disposed in the base, adaptable for rotational movement from a first, closed, position, to a second, open, position;

a first, second and third stationary contact disposed in the base, each stationary contact associated with a respective movable contact whereby the respective movable contact is physically connected to the stationary contact when the movable contact is in the first position;

a first magnet disposed within the cover of the base proximate the first movable contact on a side of the movable contact opposite the side facing the second movable contact, the first magnet oriented substantially parallel to an axis of travel of the first, second and third movable contacts when transitioning from their respective first positions to their respective second positions, the north pole of the first magnet facing the first movable contact;

a second magnet disposed within the cover of the base substantially along the axis of travel of the first movable contact and located proximate an end of the first stationary contact, the south pole of the second magnet oriented in the direction of the axis of the travel of the second movable contact;

a third magnet disposed within the cover of the base between the first and second movable contacts, the third magnet oriented substantially parallel to an axis of travel of the first, second and third movable contacts when transitioning from their respective first positions to their respective second positions, the north pole of the third magnet facing the second movable contact;

a fourth magnet disposed within the cover of base between the second and third movable contacts, the fourth magnet oriented substantially parallel to an axis of travel of the first, second and third movable contacts when transitioning from their respective first positions to their respective second positions, the north pole of the fourth magnet facing the third movable contact; and a fifth magnet disposed within the cover of the base substantially along the axis of travel of the third movable contact and located proximate an end of the third stationary contact, the north pole of the fifth magnet oriented in the direction of the axis of the travel of the second movable contact; and wherein upon an arc generated by each of the first, second and third movable contacts upon transitioning from their respective first positions to their respective second positions, the arc is extinguished by the magnetic fields of the second and fifth magnets attracting the arc to lengthen the arc and increase its voltage, and by the magnetic fields of the first, third, and fourth, magnets attracting, repulsing, and twisting the arc to lengthen the arc and increase its voltage.

* * * * *